US005269222A

United States Patent [19]

Johnson et al.

[11] Patent Number: 5,269,222

[45] Date of Patent: Dec. 14, 1993

[54] VARIABLE TENSION CONTROLLER FOR ROTARY PRINTING PRESS

[76] Inventors: Robert W. Johnson, 433 Solano Dr., Benecia, Calif. 94510; Carl Stoffels, 864 Amwell Rd., Flemington, N.J. 08822; Sam Musa, 180 Brannan St., Apt. 217, San Francisco, Calif. 94107

[21] Appl. No.: 38,254

[22] Filed: Mar. 29, 1993

[51] Int. Cl.[5] ..... B41F 5/06; B65H 23/14; B65H 23/188

[52] U.S. Cl. ..... 101/228; 101/484

[58] Field of Search ..... 101/228, 219, 181, 220, 101/221, 222–227, 178, 179, 180, 182, 138, 139, 143, 484–486; 226/24, 28, 29, 30, 31, 38, 40, 42, 195

[56] References Cited

U.S. PATENT DOCUMENTS

| | | | |
|---|---|---|---|
| 4,004,510 | 1/1977 | Roch | 101/228 |
| 4,096,801 | 6/1978 | Martin | 101/227 |
| 5,020,431 | 6/1991 | Shibuya | 101/228 |

*Primary Examiner*—J. Reed Fisher
*Attorney, Agent, or Firm*—Harris Zimmerman

[57] ABSTRACT

Apparatus for controlling the tension of each lead of a multiple lead printing press setup includes a transducer roller interposed in the lead setup to detect the gain (increased tension) in the paper web as it exits from the print cylinder unit. An electronically controlled variable ratio gear assembly is interposed between the drag roller and the drag roller driver shaft. A variable gain tension controller receives the gain signal from the transducer roller and a tachometer signal from the main press drive shaft, as well as a gain setpoint signal. The variable ratio gear assembly includes an harmonic gear assembly and a control motor connected to the harmonic wave generator. The output controller signal of the variable gain tension controller is fed to the control motor to selectively vary the rotational velocity of the wave generator, thereby varying rotational speed of the drag roller and regulating the tension of the paper web. Gain regulation permits the printing setup to operate at a far lower web tension than is possible with prior art systems, and permits the use of a wider range of paper, such as paper having a higher recycled fiber content. Changes in the printing setup which alter the friction applied to the web are compensated automatically, so that web breakage is minimized. The system produces greater throughput, higher productivity, and lower labor costs for setup and operation. Also, each web lead is compensated and regulated individually, so that the web tension at this input to the folder are regulated and optimized for the folder. This factor improves the performance of the folder apparatus.

14 Claims, 3 Drawing Sheets

VARIABLE TENSION CONTROLLER FOR ROTARY PRINTING PRESS

BACKGROUND OF THE INVENTION

The field of the invention is rotary printing press technology, and in particular high speed rotary presses for producing high volume output such as newspaper production and the like.

In all rotary printing press machines, a common problem is control of the tension of the paper web passing through the printing cylinder and the associated feed rollers, angle bars, folders, and the like. The paper web undergoes an increase in tension as it transits these parts of the printing press setup, and the increase in tension, termed gain, is a siginficant factor in press setup and operation.

Gain is due primarily to differences in rotational speeds of the rollers over which the paper web passes, resulting in surface speed differences which apply tension differentials to the paper web. When the web tension exceeds the tensile strength of the paper, the paper web breaks, causing press shutdown and requiring a press crew to reset the paper in the press and the roller setup. Any down-time of the printing press represents a significant loss of production capacity. In addition, the printing business is frequently dealing with deadlines, and the loss of revenue due to missing deadlines can be a crucial factor in printing press profitability.

It has been noted that frictional forces appear to comprise a more important component of gain in the Flexo printing process as compared to prior art letterpress operation. This fact is apparently due to the fact that the Flexo process commonly uses water-based ink, whereas other printing processes use oil-based ink. The oil-based inks produce a lower coefficient of friction as the web slides over the rollers and angle bars. In contrast, the water-based inks used in the Flexo process moisture is absorbed into the paper, creating a dry surface with a correspondingly higher coefficient of friction. This phenomenon in turn creates increased frictional forces at each contact surface between the paper web and the rollers and angle bars of the printing setup. These greater frictional forces must be overcome by increased pull from the drag roller and the RTF, causing higher web tension that must be compensated during press setup.

Several strategies are known in the prior art for dealing with this web tension problem. The individual leads from the printing press units may be overfed or underfed to compensate for the inherent differences in resultant web tension, which is a function of varying lead lengths and roller/angle bar configurations. Over- and underfeeding from printing press units is limited in the Flexo setup by the fact that a Flexo plate can be damaged by excessive impression, a result of overpacking. Considering a common base line of 0.145 inch range of overpacking on a 44 inch printing cylinder, it is possible to obtain only a 0.3% adjustment to the gain, far below what is required to compensate for many lead configurations.

Alternatively, it is possible to adjust the folder bands, nips, and RTF. However, adjusting the folder is limited by the fact that folder adjustment results in uniform changes to the pull on all the leads, which does not solve the problem of varying lead tension setup requirements. It is also possible to install Velcro on critical roller surfaces to reduce frictional effects of web travel.

This is a labor intensive task which must be repeated frequently as a function of wear. Although Velcro reduces the coefficient of friction of the web, it falls far short of the slidability provided by oil-based inks.

An obvious answer to the problem of gain is a mechanical solution: alter the gear ratio of the drag rollers with respect to the printing press to select the optimum drag for what is deemed to be the most common lead configuration. If a fixed lead configuration is used, this approach will work. However, in most printing operations, such as newspaper production, the lead configuration is altered frequently in accordance with changes in the configuration of the printed output.

SUMMARY OF THE INVENTION

The present invention generally comprises an apparatus for controlling the gain or tension of each lead of a multiple lead printing press setup. The apparatus compensates for varying web configurations and also overcomes the increased frictional forces inherent in the Flexo process.

The apparatus of the invention includes a transducer roller interposed in the lead setup to detect the gain in the paper web as it exits from the print cylinder unit. The apparatus also includes a variable gain tensioner gear assembled to a roller in the drag roller assembly of the press setup. A variable gain tension controller, which may be a discrete component electronic circuit or a microprocessor under program control, receives a gain signal from the transducer roller and a tachometer signal from the main press drive shaft, as well as a gain setpoint signal. The output signal of the variable gain tension controller is fed to the variable gain tensioner gear assembly, which responds by varying the tension of the paper web passing thereby.

The variable gain tensioner gear assembly includes an harmonic gear assembly interposed between the drag roller drive shaft and drag roller itself. The harmonic gear assembly includes two circular spline gears which mesh with a slightly smaller common flexspline to create a single stage gear reduction that is extremely compact in the axial direction. A wave generator, comprising an elliptical bearing and rotating input element, impinges on the interior surface of the flexspline to impart a rotating elliptical shape to the flexspline. The flexspline gear has external spline teeth that progressively engage the internal teeth of a static circular spline and a dynamic circular spline at the major axis of its rotating elliptical shape. A control motor is connected to the wave generator; by controlling the rotational velocity of the wave generator, the input/output drive ratio between the static circular spline and the dynamic circular spline output is varied with extreme precision. The signal from the variable gain tension controller drives the control motor to effect selected variation in the drive velocity of the drag roller, thereby varying the web tension and regulating the gain of the printing setup.

A major advantage of the invention is that the gain regulation permits the printing setup to operate at a far lower web tension than is possible with prior art systems. This factor permits the use of a wider range of paper, such as paper having a higher recycled fiber content, and also results in a decrease in paper waste. Furthermore, changes in the printing setup which alter the friction applied to the web are compensated automatically, whereas the fixed gear ratios of prior art drag roller assemblies cannot accommodate changes in the printing setup and must be set at a fixed, nominal drive speed. The invention produces greater throughput, higher productivity, and lower labor costs for setup and operation. Also, each web lead is compensated and regulated individually, so that the web tensions at the input to the folder are regulated and optimized for the folder. This factor improves the performance of the folder apparatus.

A further advantage of the invention is that it incorporates a fault tolerant control system. If a failure should occur in the electronic control system, the drag roller drive reverts to a direct gear drive from the drag roller shaft at a fixed gear ratio. That is, the system will revert to a drive mode that is no worse than the best prior art printing setup.

DESCRIPTION OF THE PREFERRED EMBODIMENT

Figure 1:
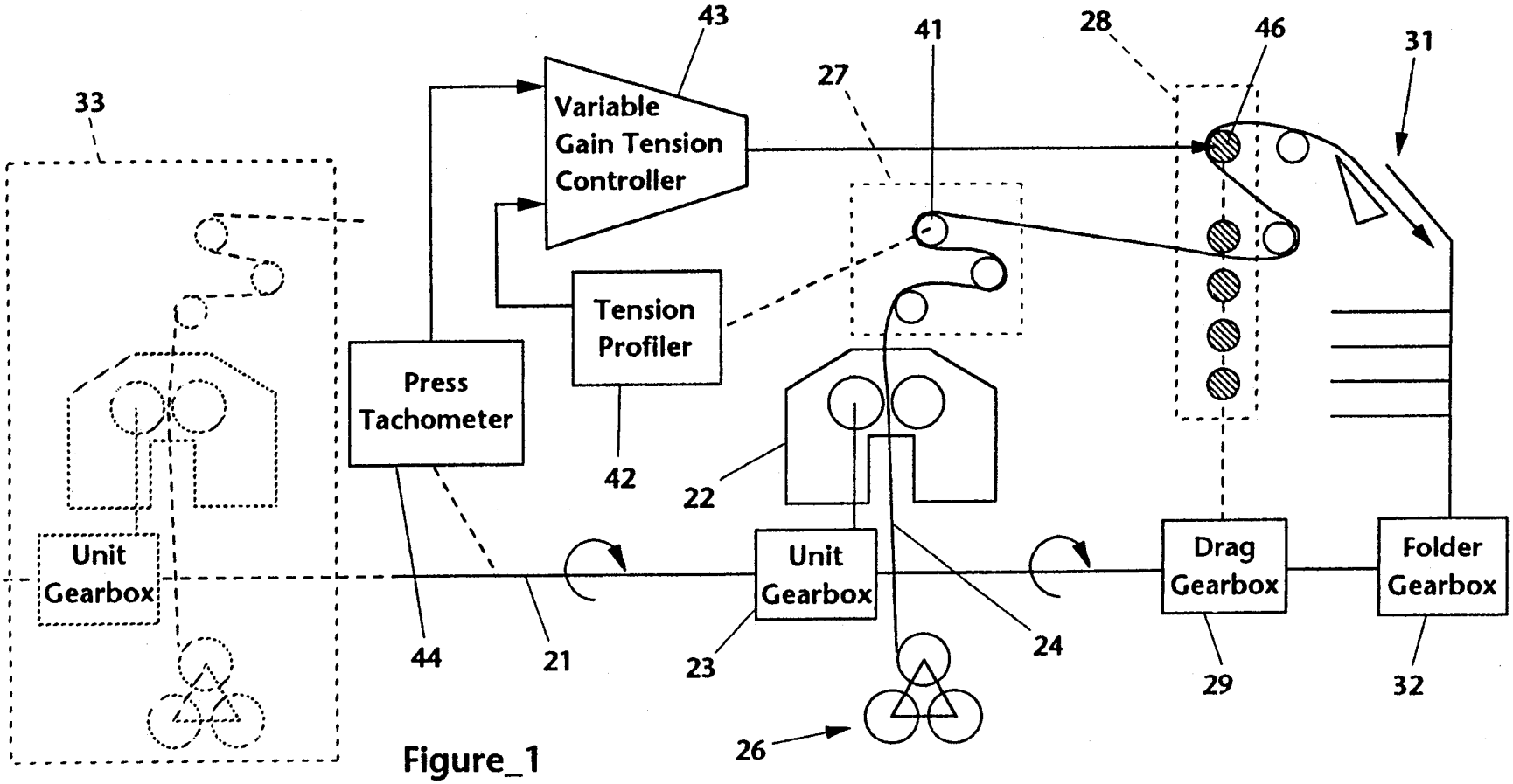
FIG. 1 is a schematic depiction of the variable gain control system of the present invention applied to a representative rotary printing press setup.

The present invention generally comprises an apparatus for controlling and regulating the web tension of a paper web passing through a rotary press printing setup. The invention is described with reference to high speed, high volume printing apparatus, as commonly used to produce newspapers and other large printing projects, although the invention is applicable to printing setups in general and to other manufacturing processes that employ a high speed web passing through production machinery. With regard to FIG. 1, a representative rotary printing press setup typically includes a main press drive shaft 21 that turns all of the printing devices in the setup. A rotary printing press unit 22 is connected to the main shaft 21 through a unit gear box 23, so that the rotary printing press unit 22 is driven to rotate and imprint on a paper web 24 fed from a paper feed supply apparatus 26. The printed web passes through a plurality of idle rollers 27 to a drag roller assembly 28. The rollers of the drag roller assembly 28 are driven from the main press drive shaft 21 through the drag gear box 29, so that the drag rollers act to pull the paper web 24 from the press unit through the idle rollers. From the drag roller assembly 28 the paper web passes to a folder assembly, which is also driven from the main shaft 21 through a folder gear box 32. The folder 31 cuts and folds the paper web to form a finished newspaper or the like.

It may be appreciated that a typical printing setup often includes a plurality of printing press units 22 and associated idle rollers 27, as indicated by reference numeral 33, each printing unit producing a paper web. All of the paper webs are directed toward the folder assembly, where the multiple webs are processed and assembled automatically. Due to the plurality of press units, the distance from each press unit to the folder assembly will necessarily differ greatly, and the combinations of idle rollers required for each web will likewise differ. Thus the tension required to pull each web through its associated rollers will differ correspondingly, and changes in the makeup of each printing unit arrangement will change the tension on the web. However, the drag gear box 29 provides a fixed rotational velocity for the drag rollers 28, and the drive ratio set by the drag gear box is not easily changed. The arrangement described so far with reference to FIG. 1 is typical of the prior art, and explicates the deficiencies in the prior art noted above.

The present invention overcomes prior art problems in web tension (gain) by providing an apparatus for controlling and regulating the rotational velocity of the respective drag rollers associated with each paper web 24 passing through the drag roller assembly. The apparatus includes a transducer for sensing the tension on each web 24. In the preferred embodiment the transducer comprises an idler roller that is modified to incorporate strain gauges that generate signals proportional to the tension on the respective web. The strain gauges are mounted at opposed ends of the idler roller, as is known in the prior art, and the strain gauge signals are conducted to a tension profiler 42. The tension profiler sums the strain gauge signals and conditions the summed signal, and feeds the resulting tension signal to a variable gain tension controller 43.

The apparatus further includes a press tachometer 44 that generates an electronic signal proportional to the rotational speed of the main press drive shaft 21. The tachometer signal is also fed to the variable gain tension controller 43. Another component of the apparatus is a variable ratio transmission that is interposed between the drag gear box 29 and each of the drag rollers 46, as will be explained in the following specification. The variable gain tensioner controller processes the inputs from the tachometer 44 and the tension profiler 42, and generates a drive signal that controls the variable ratio transmission to selectively regulate the drag roller speed and thus regulate the tension of the web 24. As noted previously, each of the printing press units 33 may be provided with a tension transducer 41 and a tension profiler 42, and the corresponding drag roller in the drag roller assembly is provided with a variable ratio transmission that is operated by a respective controller 43.

Figure 2:
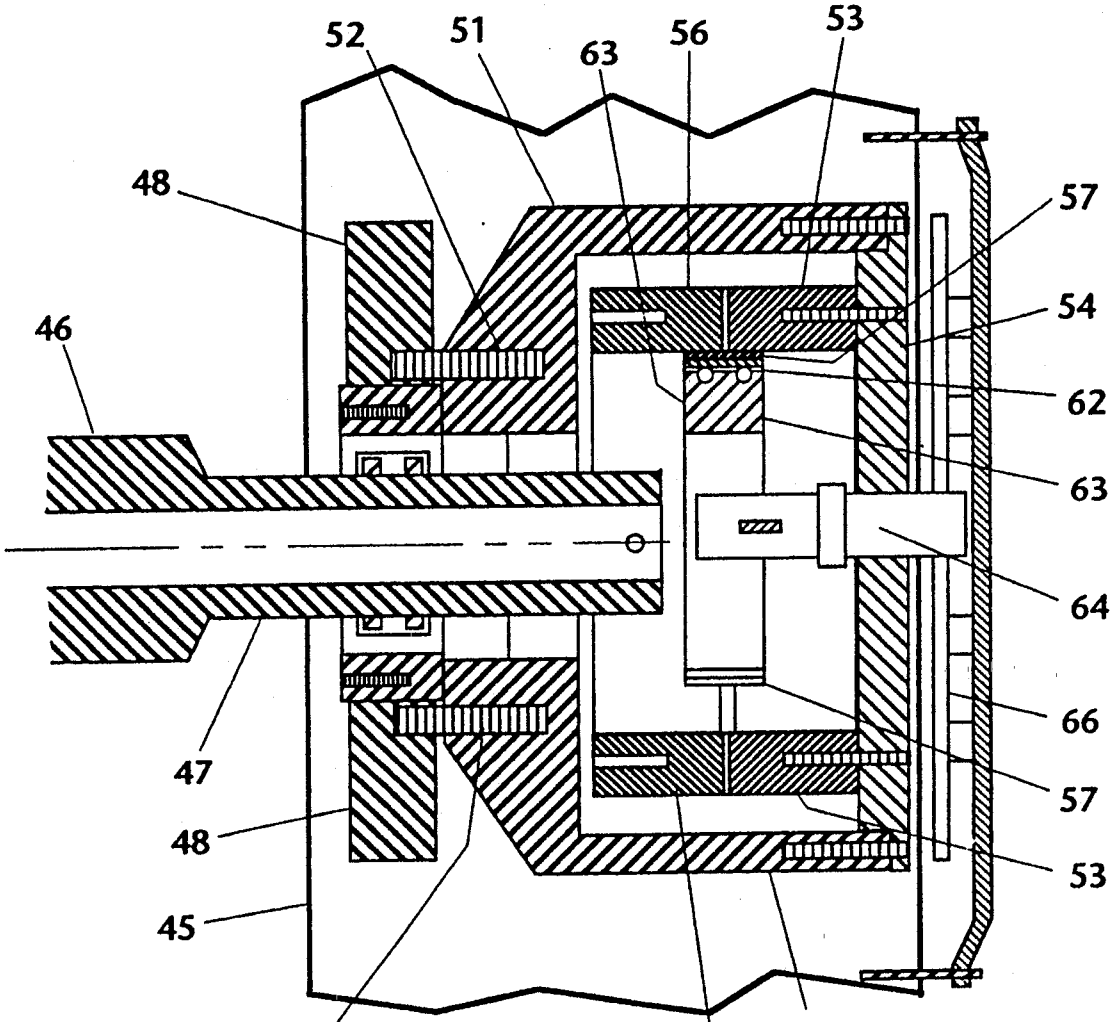
FIG. 2 is a cross-sectional side view of a typical existing drag roller drive assembly that is modified in accordance with the present invention to become a variable speed drag roller.

With regard to FIG. 2, each drag roller 46 includes a shaft end portion 47 that extends into an existing drag roller gear housing 45. The shaft end is supported by bearings 49 in freely rotating fashion. An original drag roller gear 48 is secured concentrically about the shaft end portion 47, the gear 48 being operatively connected to the drag gear box 29 and originally connected to provide rotational drive directly to the roller through intermediate reduction gears. However, the present invention modifies the original arrangement by removing the reduction gear linkage. Rather, a hub housing 51 is secured directly to the gear 48 by bolts 52 to rotate in concert therewith. Within the housing 51 a static circular spline gear 53 is mounted on a cover plate 54 that is secured to the housing 53, so that the gear 53 rotates in common with the housing 53. Also disposed within the housing 53 is a dynamic spline gear 56 that is fixedly secured to the drag roller shaft end 47 (by a cover plate that is not shown for graphic simplicity) for rotation in common therewith. Both of the spline gears 53 and 56 are internal spline gears that mesh with a common external spline gear 57. The spline gear 57 is smaller in diameter that the gears 53 and 56. A wave generator 61, comprising an elliptical bearing 62 and a rotating input element 63, is disposed within the gear 57 and coupled to a rotatable input shaft 64. The shaft 64 is directly connected to the output of a precision controlled electric motor, such as a synchronous pancake motor 66.

The static internal spline gear 53 is provided with two more teeth than the external spline gear 57 to establish a positive transmission reduction ratio equal to one-half the number of teeth on the external spline gear 57. The internal spline gear 56 has the same number of teeth, and turns in the same direction as the gear 57. The wave generator 61 imparts a rotating elliptical shape to the gear 57, which progressively engages the internal teeth of the gears 53 and 56 at the major axis of its rotating elliptical shape. The gear 57 rotates in the opposite direction of the wave generator 61. Speed reduction relative to the wave generator is equal to one-half the number of teeth on the gear 57. In addition, rotation of the wave generator can accomplish significant speed reduction to vary the rotational speed of the roller and regulate the tension of the paper web passing about the roller 46. This gear arrangement, known as a harmonic gear assembly in the prior art, is controlled by the rotational speed of the motor 66, which is required to produce precise rotational speed with a very low torque requirement. Thus the large amount of torque required to rotate the roller 46 is controlled by a small, precise electric motor that produces a variable speed, low torque output.

It is significant to note that a failure of the motor 66 or its driving signal results in the gear train locking into a fixed gear reduction that is approximately equal to prior art fixed gear drives for drag roller assemblies. Thus the drive system of the invention is fail-safe, in that shutdown of the control system causes the drag roller assembly to revert to a drive mode that is no worse than state of the art drag roller drive systems.

Figure 3:
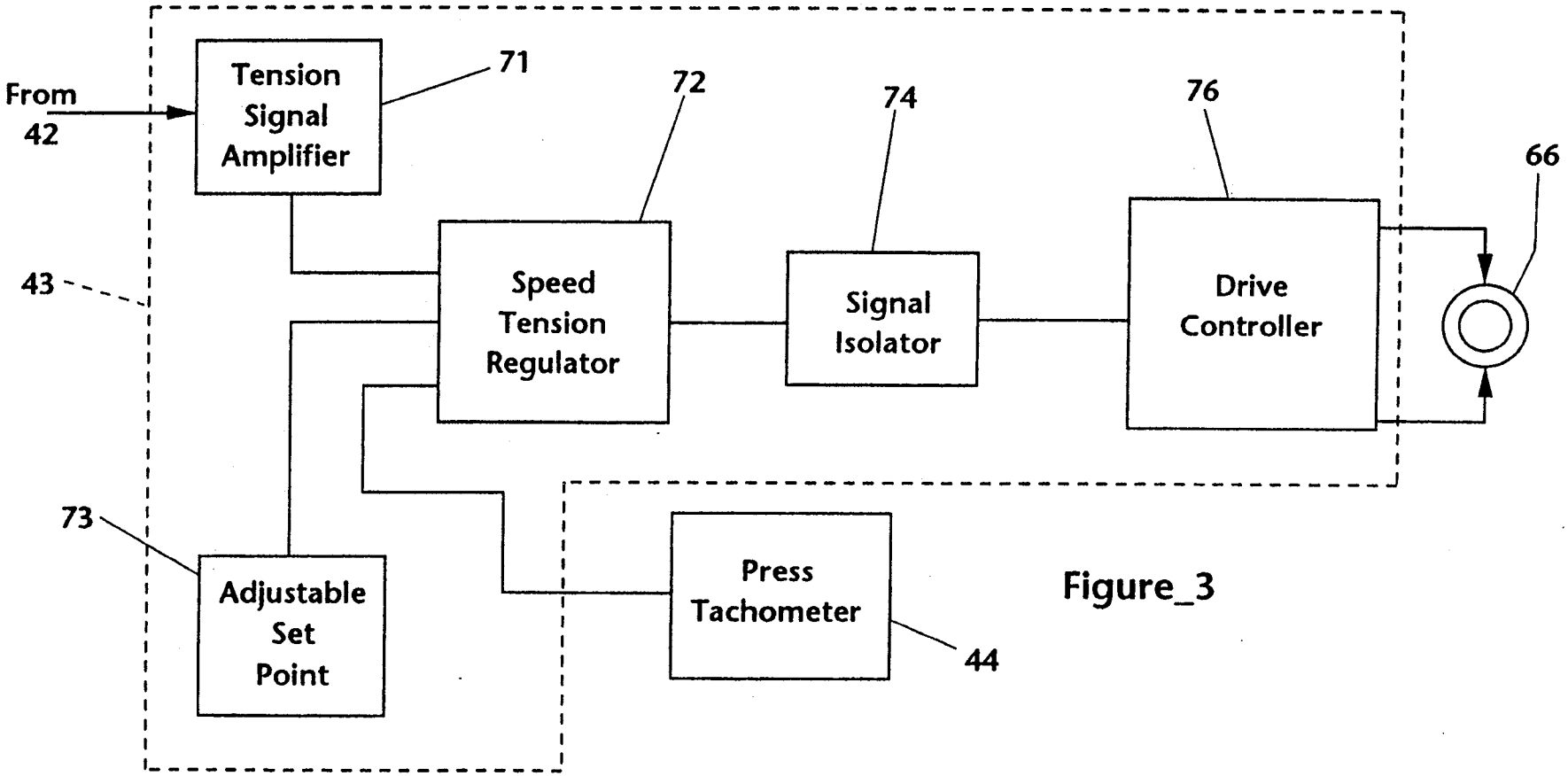
FIG. 3 is a functional block diagram of the variable gain tension controller portion of the present invention.

With regard to FIG. 3, the variable tension gain controller portion of the apparatus includes a tension signal amplifier 71 that receives the signal from the tension profiler 42 and amplifies and conditions the signal and conducts it to a speed tension regulator 72. The regulator 72 also receives a set point signal from an adjustable set point signal generator, and the tachometer signal from the press tachometer 44. The regulator 72 comprises an electronic circuit that evaluates the signal inputs and produces a regulator signal that is fed through a signal isolator 74 to a drive controller 76. The drive controller generates a variable frequency AC signal in response to the regulator signal, the variable frequency corresponding to the desired speed reduction required for achieving the desired set point web tension. The regulator 72 may comprise an analog circuit formed of discrete components, a logic circuit formed of discrete components, or a microprocessor-based circuit having an operating program and associated data and program memory.

The apparatus described herein particularly applicable to Flexo printing setups, which typically employ water-based inks that substantially increase the sliding friction of the paper web passing over the feed rollers, idle rollers and fixed bars, and the drag rollers. Paper webs which undergo tension in the range of 80–100 lbs in a typical Flexo printing setup are operating at the brink of the web breaking strength; by applying the apparatus of the invention to the typical Flexo printing setup, the web tension may be reduced to a range of 20 lbs–50 lbs, well below the breaking point of the paper web. As a result, web breakage and the attendant press down-time are virtually eliminated, and press production is correspondingly increased. Moreover, paper compositions that include higher percentages of recycled and reclaimed fibers, which generally have lower tensile strength, may be used in a standard Flexo printing setup equipped with the apparatus of the invention without increased risk of web breakage and press shutdown.

Although the apparatus of the invention has been described with reference to a paper printing process, it may be appreciated that the apparatus may be applied to other processes in which webs are drawn through rotary machines for production purposes. For example, textile printing, paper manufacturing, paper conversion machines, laminating machinery, and the like may benefit from the apparatus for controlling web tension.

We claim:

1. In a printing press having a drag roller for drawing a continuous paper web through a rotating cylinder printing unit, an apparatus for controlling and regulating the tension in the continuous paper web, said apparatus including;

transducer means for sensing the tension in the web and generating a web tension signal;

variable ratio transmission means coupled to said drag roller for varying the rotational speed of said drag roller;

electronic means for selectively varying the ratio of said variable ratio transmission means; and, controller means for receiving said web tension signal and generating a control signal to operate said electronic means and regulate said rotational speed of said drag roller, whereby said tension in the web is regulated.

2. The apparatus of claim 1, wherein said transducer means includes an idler roller disposed so that said web passes about a circumferential portion of said idler roller, and strain gauge means for sensing the force applied to said idler roller by said web.

3. The apparatus of claim 1, further including drive shaft means for rotating said cylinder printing unit and said drag roller, said variable ratio transmission means operatively connected between said drive shaft means and said drag roller.

4. The apparatus of claim 3, wherein said variable ratio transmission means includes an harmonic gear assembly having a rotational input connected to said drive shaft means and a variable rotational output connected to said drag roller.

5. The apparatus of claim 4, wherein said harmonic gear assembly includes a rotatable wave generator control element, and said electronic means is operatively connected to said rotatable wave generator control element.

6. The apparatus of claim 5, wherein said electronic means includes a electric motor means controllable to rotate at a rotational rate that is variable and precisely controllable.

7. The apparatus of claim 6, wherein said control signal from said controller means comprises a speed control signal for said electric motor means.

8. The apparatus of claim 7, wherein said electric motor means comprises a precision synchronous motor, and said speed control signal comprises a variable frequency AC signal to operate said synchronous motor at a rotational speed that is selectively variable in proportion to the frequency of said AC signal.

9. The apparatus of claim 8, further including tachometer means operatively connected to said drive shaft means for generating a tachometer representing the rotational speed of said drive shaft means, said controller means including means for receiving said tachometer signal.

10. The apparatus of claim 9, wherein said controller means further includes set point means for generating a set point signal proportional to the desired tension in said web, said controller including means for operationally evaluating inputs comprising said tachometer signal and said web tension signal and said set point signal and generating said control signal in response to said inputs.

11. An apparatus for controlling and regulating the tension in a web drawn through a rotary machine by a drag roller, including;

transducer means for sensing the tension in the web and generating a web tension signal;

variable ratio transmission means coupled to said drag roller for varying the rotational speed of said drag roller;

electronic means for selectively varying the ratio of said variable ratio transmission means; and, controller means for receiving said web tension signal and generating a control signal to operate said electronic means and regulate said rotational speed of said drag roller, whereby said tension in the web is regulated.

12. In a printing press having a drag roller for drawing a continuous paper web through a rotating cylinder printing unit, a method for controlling and regulating the tension in the continuous paper web, including the steps of;

sensing the tension in the web and generating a web tension signal;

providing a variable ratio transmission coupled to said drag roller for varying the rotational speed of said drag roller;

providing an electronic device for selectively varying the ratio of said variable ratio transmission means; and, providing an electronic controller for receiving said web tension signal and generating a control signal to operate said electronic device and regulate said rotational speed of said drag roller, whereby said tension in the web is regulated.

13. The method for controlling and regulating the tension in the continuous paper web of claim 12, further including the step of providing a harmonic gear transmission coupled to said drag roller, and selectively varying the rotational speed of the wave generator input control element of said harmonic gear transmission to control the rotational speed of said drag roller.

14. The method for controlling and regulating the tension in the continuous paper web of claim 12, further including the step of generating a set point signal proportional to the desired tension in said web, said electronic controller receiving said set point signal and comparing said set point signal and said web tension signal and generating said control signal in correspondence to the difference between said web tension signal and said set point signal.

* * * * *